United States Patent [19]

Vollrath et al.

[11] Patent Number: 4,828,112

[45] Date of Patent: May 9, 1989

[54] METAL TRANSPORT PAN

[75] Inventors: Richard J. Vollrath; Christopher R. Vollrath, both of Sheboygan, Wis.

[73] Assignee: Polar Ware Company, Sheboygan, Wis.

[21] Appl. No.: 60,838

[22] Filed: Jun. 12, 1987

[51] Int. Cl.[4] ..... B65D 21/02

[52] U.S. Cl. ..... 206/519; 206/520; 220/74

[58] Field of Search ..... 206/518, 519, 520; 220/74

[56] References Cited

U.S. PATENT DOCUMENTS

| | | | |
|---|---|---|---|
| 3,233,812 | 2/1966 | Kennedy | 206/518 |
| 3,558,002 | 1/1971 | Lindgren | 220/74 |
| 3,884,383 | 5/1975 | Burch | 206/519 |
| 4,113,095 | 9/1978 | Dietz | 206/518 |
| 4,660,734 | 4/1987 | Heaney | 206/518 |

FOREIGN PATENT DOCUMENTS

| | | | |
|---|---|---|---|
| 198037 | 5/1923 | United Kingdom | 206/519 |

OTHER PUBLICATIONS

Photocopy of brochure of Polar Ware Company published 1984.

Photocopy of photo of Nested Round Metal Bowls of the Type Sold by Polar Ware Company in 1969–1970.

*Primary Examiner*—George E. Lowrance

*Attorney, Agent, or Firm*—Wood, Dalton, Phillips, Mason & Rowe

[57] ABSTRACT

A metal transport pan having front, rear and end side walls extending downwardly with a slight inward taper and which are joined at curved corners, the lower parts of which have a similar taper and a top flange extending outwardly from the top of the side walls. Each of the curved corners has a nontapered section extending downwardly from the top flange generally at a right angle thereto to provide an outwardly protruding ridge whereby the spaced-apart ridges define a plurality of nesting surfaces for engagement with the top flange of a subjacent pan to limit the extent to which one pan may nest into the other and prevent contact between the side walls of the nested pans to maintain the stacked pans in nonjamming relation. The nontapered sections of the curved corners are formed at the same time as a conventional pan-forming draw is being performed in order to avoid any additional manufacturing steps.

6 Claims, 2 Drawing Sheets

FIG. 1
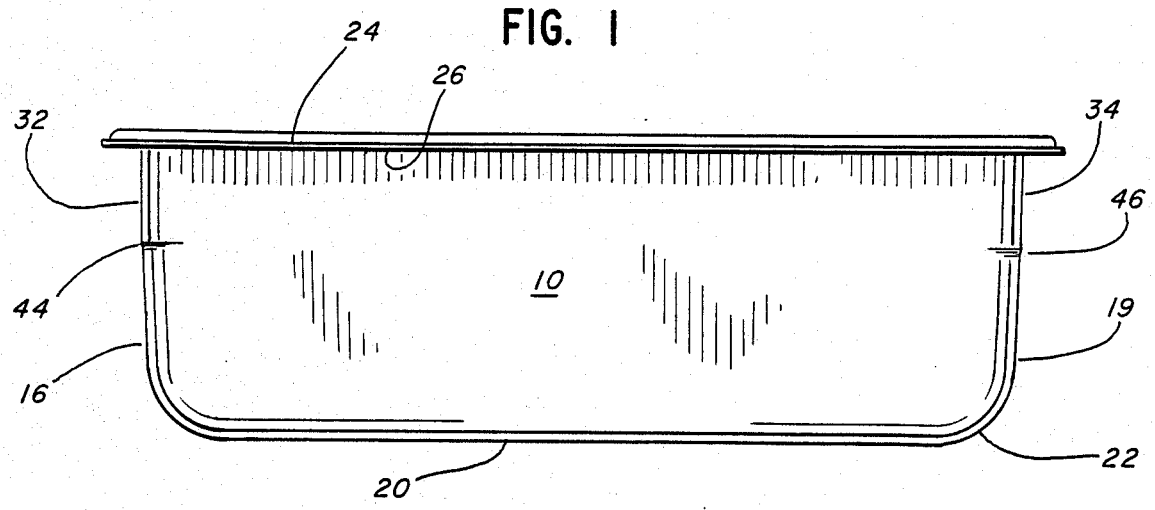
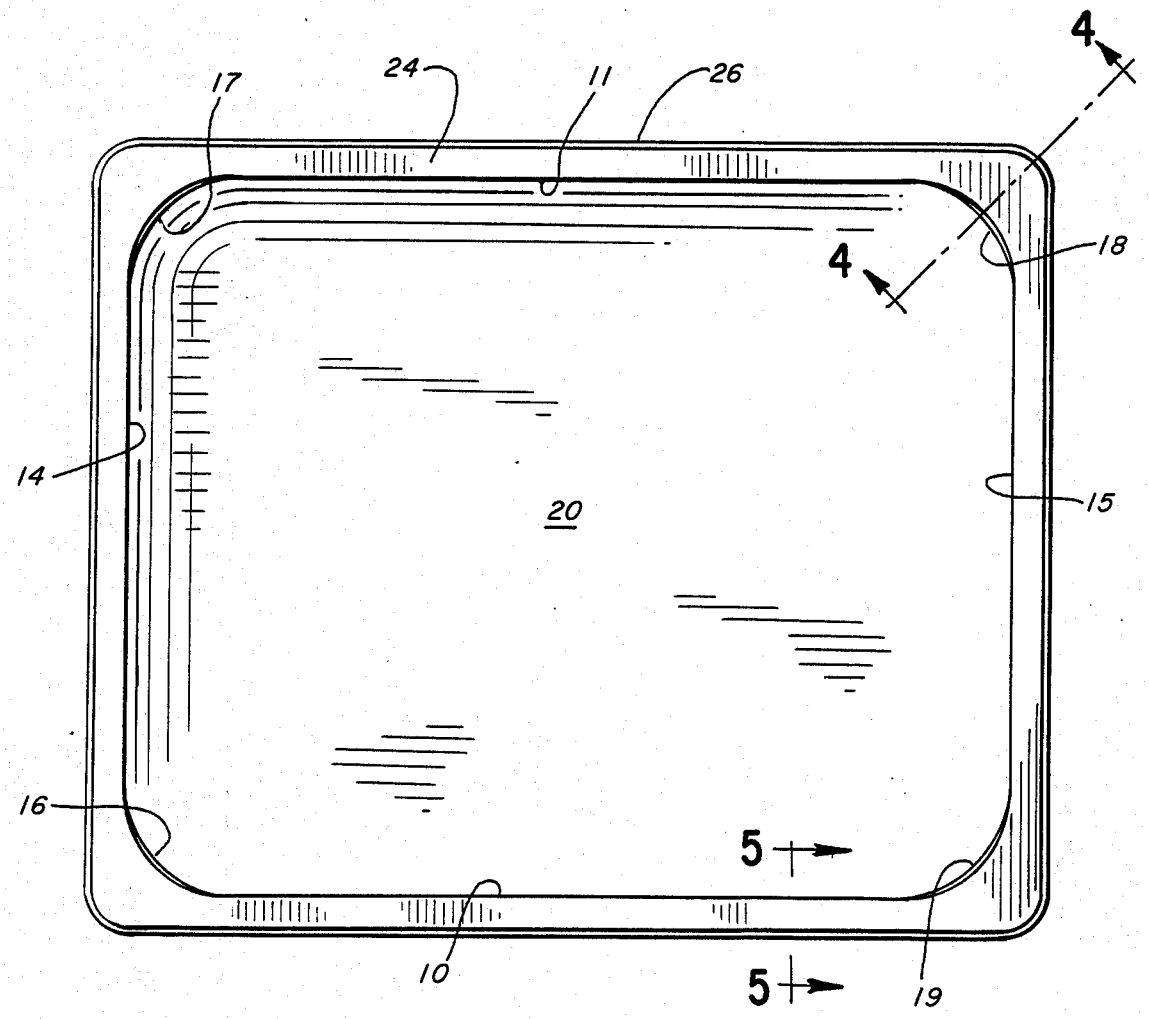
FIG. 2

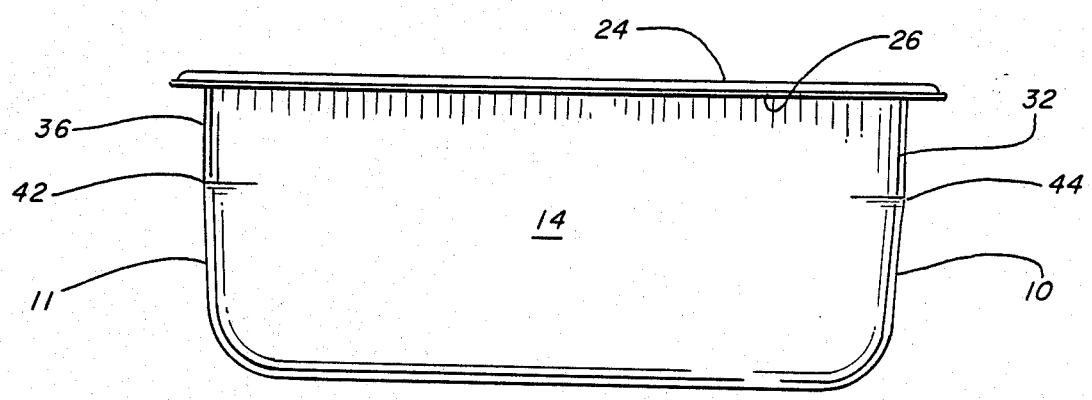
FIG. 3
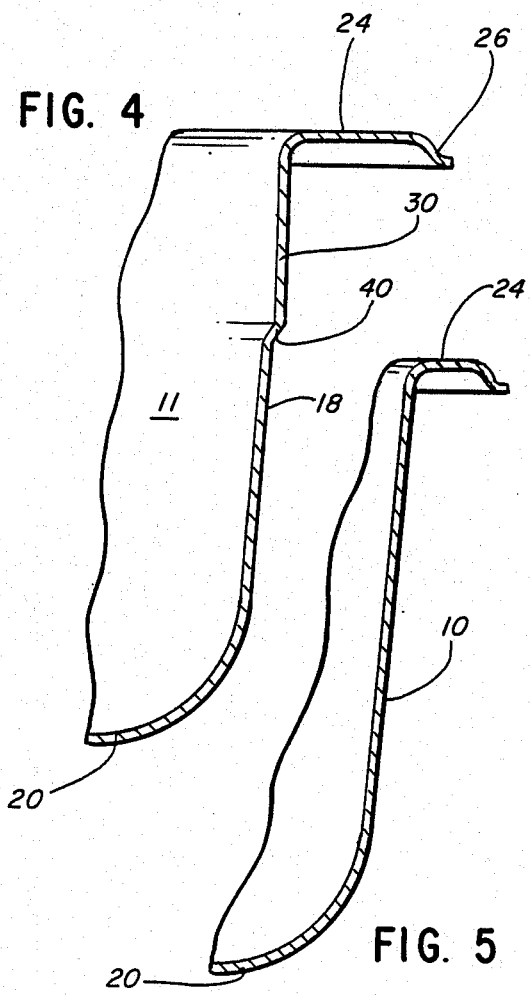
FIG. 4
FIG. 5
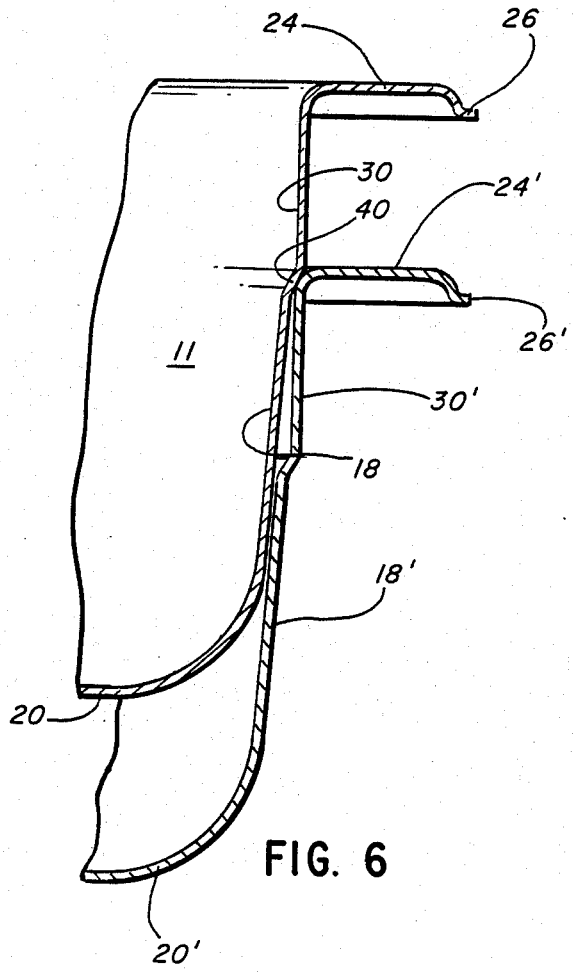
FIG. 6

METAL TRANSPORT PAN

FIELD OF THE INVENTION

This invention relates to a metal transport pan primarily for food service having an optimal tapered shape for good drawing features, maximizing the capacity thereof and enabling stacking in partially nested relation with another pan and having parts thereof shaped in the pan-drawing process so that the pans can stack in a nonjamming relation to enable easy separation of one pan from the other.

BACKGROUND OF THE INVENTION

Metal transport pans, commonly made of stainless steel are extensively used for food serving and transport in restaurants and in institutions such as hospitals. The transport pan can be removably positioned in a steam table, or mounted in some other holder.

The metal transport pans are typically formed from an initially flat sheet of metal by one or more draws between a punch and die to have a perimetric wall structure and an outwardly-extending flange at the top thereof.

In determining the shape and dimensions of the pan, it is necessary to have the pan dimensioned to have good drawing features and to also have a shape to be usable for the intended purpose. In order to have a pan which will stack with other similar pans for storage in partially nested relation, it is necessary for the perimetric wall structure to have a downward and inward taper. However, it is desirable to minimize this taper to maximize the dimension at the bottom of the pan to achieve a maximum holding capacity therefor.

Applicants' assignee manufactures a transport pan of stainless steel, Product No. F2004, which is of a rectangular shape having front, rear and end side walls, all of which taper downwardly and inwardly at a moderately large angle from a surrounding outwardly-extending top flange. For a short distance below the top flange, the tapered side walls are formed with an outward offset to form a continuous internal shelf for support of a cover for the pan. Because of the taper, two identical pans can nest partially one within the other. The outward offset which forms an outwardly-protruding ridge does not prevent jamming between the pans because the outwardly-protruding continuous ridge does not rest on the flange of the subjacent pan to prevent jamming between the tapered walls of the nested pans. The angle of wall taper is sufficiently large that the interior periphery of the flange of the subjacent pan has a perimetric dimension larger than that of the outwardly-protruding ridge of the uppermost pan, so that the ridge will not contact the subjacent pan flange and prevent full nesting of the pans.

Another pan of applicants' assignee, No. F-1314, is of generally the same construction as the pan described in the preceding paragraph, except that the side walls have a very slight taper and, when two similar pans are nested, the pans jam together before the outwardly-protruding ridge on one pan reaches the flange of the subjacent pan. As a result, one pan can jam within the other and render separation thereof extremely difficult and there is no coaction between a ridge and flange of nested pans to prevent jamming.

Another commercially available pan of a generally rectangular configuration has front, rear and end side walls, with an outwardly-extending top flange and with the side walls being joined at curved corners. Both the flanges and the uppermost part of the curved corners are concavely deformed, apparently for strengthening of the flange. The deformations formed in the curved corners of one pan fit within the deformations of a subjacent pan when the pans, which have a relatively slight downward and inward taper to the side walls, nest one within the other. The deformations in the curved corners have a taper similar to that of the side walls, so that there is a tight fit between the curved corner deformations and the side walls of substantially fully nested pans. As a result, the pans can be firmly jammed together and it is extremely difficult to separate one pan from the other.

Applicants' assignee has manufactured and sold a round metal bowl, with the perimetric wall structure having a downward and inward taper and an outwardly-extending top flange. The taper of the bowl enables substantially full nesting of such a bowl within a subjacent bowl of the same dimensions. In order to prevent jamming of the bowls to each other, the perimetric wall structure has three equally circumferentially spaced-apart dimples at a distance below the top flange to provide outward protrusions in the perimetric wall structure. These protrusions can engage a top flange of a subjacent bowl and prevent full nesting and maintain the bowls in a nonjamming relation. The use of the dimples provided a bowl structure which would prevent jamming of nested bowls. However, the formation of a plurality of dimples in the tapered perimetric wall structure of a bowl or pan is not cost-effective because of the additional number of operations required to form the dimples.

The prior art is not known to disclose a transport pan with a perimetric wall structure including curved corners having a slight inward taper to facilitate nesting of a plurality of the pans and which has a nonjamming feature by forming an upper part of the curved corners immediately below the top flange of the pan, with a straight wall at a right angle to the top flange, rather than a tapered wall, in the pan-forming process. This results in localized, outwardly-extending ridges at the curved corners of the pan which directly underlie the top flange of the pan whereby a pan may partially nest within a subjacent pan of the same dimensions and with the localized outwardly-protruding ridges engaging and resting on the top flange of the subjacent pan. This limits the metal-to-metal contact between the two pans to that between the ridges and the top flanges and prevents any contact between the tapered walls of the pans to avoid jamming of the pans.

SUMMARY OF THE INVENTION

A primary feature of the invention is to provide a metal transport pan having a perimetric wall structure with a slight inward taper to facilitate formation thereof in metal drawing operations as well as nesting of pans and a peripheral top flange and having parts of the perimetric wall structure immediately beneath the top flange formed without a taper to provide perip-herally-spaced, outwardly-protruding ridges providing nesting surfaces to engage and rest on the top flange of a subjacent pan of the same dimensions. This enables partial nesting of the pans in a nonjamming relation.

An object of the invention is to provide a metal transport pan having a perimetric wall structure with a slight inward taper and a peripheral top flange and with peripherally spaced-apart sections of the perimetric wall structure immediately adjacent the top flange being drawn in the pan-forming operation at a right angle to the top flange to provide straight, nontapered wall sections which, at their lower edge, define outwardly protruding ridges which can rest upon the top flange of a subjacent pan of the same dimensions to limit the nesting of one pan within the other and preclude contact between the tapered perimetric wall sections of the nested pans.

Still another object of the invention is to provide a metal transport pan which is formed in a drawing operation by shaping of a sheet of metal, such as stainless steel, between a die and punch, wherein the pan is of a generally rectangular configuration with front, rear and end side walls which are downwardly and inwardly tapered at a slight angle to maximize the bottom dimension of the pan while enabling nesting of one pan within another and wherein the nested pans are prevented from being jammed together by contact between the tapered side walls. The nonjamming feature is achieved by formation of nontapered sections of the curved corners joining the side walls immediately beneath a top flange of the pan and which resultingly define outwardly-protruding, localized ridges underlying the top flange whereby nesting of one pan within another brings the outwardly-protruding ridges defining nesting surfaces against the top flange of a subjacent pan to preclude engagement between the tapered side walls of the nested pans.

Still another object of the invention is to provide a generally rectangular metal transport pan having front, rear and end side walls extending downwardly with a slight inward taper and which are joined at curved corners and a top flange extending outwardly from the top of said side walls, the improvement comprising: a nontapered section of each curved corner extending downwardly from the top flange at right angles thereto to provide an out-wardly-protruding ridge at the lower end of each section which underlies the joinder of the top flange to the curved corner to have said protruding ridges define a series of localized nesting surfaces for four-point contact with the top flange of a subjacent pan.

An additional object of the invention is to provide a metal transport pan comprising perimetric wall means and an integral bottom curvingly joined to the perimetric wall means, a top flange integral with said perimetric wall means extending outwardly therefrom, said perimetric wall means having a downward and inward taper to facilitate nesting of the pan into a subjacent pan of the same construction, and means for preventing jamming of said pan when nested with another pan comprising spaced-apart sections of the perimetric wall means extending downwardly from the top flange which are drawn in the pan-forming process to extend generally at right angles to the top flange to define at each of their lower ends a curved outwardly-protruding ridge which taken together provide a perimetric dimension greater than that defined by the portions of the top flange which are joined to said spaced-apart sections of the perimetric wall means whereby the pan may nest with a subjacent pan with the ridges resting on the top flange of the subjacent pan to avoid the pans jamming together.

DESCRIPTION OF THE DRAWINGS

FIG. 1 is a front elevation view of the transport pan;

FIG. 2 is a plan view of the transport pan shown in FIG. 1;

FIG. 3 is an elevational view of the transport pan, looking toward one end thereof;

FIG. 4 is a vertical section, taken generally along the line 4—4 in FIG. 2 and on an enlarged scale;

FIG. 5 is a vertical section, taken generally along the line 5—5 in FIG. 2 and on an enlarged scale; and FIG. 6 is a sectional view, similar to that of FIG. 4, showing a pair of pans in nested relation.

DESCRIPTION OF THE PREFERRED EMBODIMENT

The transport pan embodying the invention is shown generally in FIGS. 1, 2, and 3. The illustrated pan is rectangular, with a plurality of side walls including a front wall 10 and a rear wall 11 and end walls 14 and 15 which are joined together at curved corners 16, 17, 18 and 9 and which together define perimetric wall means. A bottom 20 is curvingly joined to the side walls at a bottom horizontal radius and which is referred to as a knuckle radius, as indicated at 22, where a curved corner joining side walls meets the bottom horizontal radius. It will be recognized that the principles of the invention disclosed herein can be applied to pans of shapes other than rectangular, as well as bowls.

An integral top flange 24 extends horizontally outwardly from the top side walls and has a trim edge 26.

Except for sections of the curved corners of the pan immediately beneath the top flange 24, all of the side walls extend downwardly with a slight inward taper for their entire height, as seen in FIG. 5, for the front wall 10. In one embodiment, the angle of taper is approximately 3-½ to provide for good drawing features in drawing the pan from a sheet of metal, such as stainless steel. This slight degree of taper also maximizes the cubic capacity f the pan by establishing a maximum dimension of the pan bottom 20 and further contributes to the nonjamming nesting feature of the pan, as more particularly described hereinafter.

With the side wall taper, as seen in FIG. 5, it would be possible for a pan to substantially completely nest within a subjacent pan of the same dimensions and have substantial areas of contact between the exterior of the side walls of the upper pan and the interior of the side walls of the subjacent pan, with resulting jamming of the pans making it difficult to separate one pan from the other.

The disclosed transport pan has structure to preclude jamming of partially-nested pans by limiting the amount of nesting by the provision of nesting surfaces on one pan, formed in the drawing process, which can rest against the top flange of a subjacent pan at spaced locations to limit the movement of one pan into the other and prevent jamming.

The nonjamming structure consists of straight sections of the curved corners which extend downwardly from the top flange at substantially a right angle thereto. A curved corner straight section for the curved corner 18 is identified at 30. The curved corners 16 and 19 have the straight sections 32 and 34 and the curved corner 17 has the straight section 36.

The downwardly-extending, nontapered sections of each curved corner provide outwardly-protruding curved ridges or protrusions defining nesting surfaces for engagement with the inner perimeter of the top flange 24 of a subjacent pan to maintain a space between adjacent parts of the side walls of partially-nested pans.

The outwardly-protruding ridge or protrusion provided at the lower end of the straight section 30 is identified at 40 in FIG. 4 and the corresponding ridges for the other straight sections are identified at 42, 44, and 46.

The action of the nonjamming structure is best shown in FIG. 6 wherein a pair of pans of the same dimensions is shown in partially-nested relation, with the pan being shown partially-nested in a subjacent pan of the same construction and dimensions and to which the same reference numerals have been applied with a prime affixed thereto.

The side walls and curved corners of the upper pan can move into noncontacting nested relation with the corresponding components of the subjacent pan. The nesting surface 40 of the upper pan engages with the inner perimeter of the top flange 24' of the subjacent pan to preclude contact between the tapered side walls and curved corners of the pans. There is only four-point contact between pans and that is between the four arcuate ridges 40, 42, 44 and 46 and the top flange 24' at four spaced locations. The downward extension of the straight sections at generally a right angle to the top flange of the pan results in placing a ridge defining a nesting surface directly beneath the inner perimeter of the top flange whereby the nesting surfaces defined by the curved ridges will engage against the inner perimeter of a subjacent pan top flange. There is a clearance between the side walls and curved corners of the nested pans, with the uppermost pan nesting surfaces resting on the inner perimeter of the top flange of the subjacent pan.

The arcuate ridges at the four corners of the pan are sized to provide a perimetric dimension greater than the open top of the pan due to the thickness of the side walls whereby the pan may partially nest within said subjacent pan with the arcuate ridges engaging the top of the side walls of the subjacent pan.

The nonjamming structure of the pan is achieved without any additional forming steps beyond those required in conventional drawing of a pan with tapered side walls. A conventional process has an initial draw which is a straight draw of the side walls and a second draw forms the flange and taper in the side walls. For the invention, the punch and die used for the second draw can be modified to form the straight sections at the upper ends of the curved corners immediately adjacent the top flange. Additional alternate drawing processes include a first draw for forming the tapered side walls, followed by a second draw for forming the top flange and the straight sections.

We claim:

1. A metal transport pan shaped for mounting in a steam table comprising perimetric wall means and an integral bottom curvingly joined to the perimetric wall means, a top flange integral with said perimetric wall means extending outwardly therefrom and shaped to completely cover an opening in a steam table, said perimetric wall means having a uniform downward and inward taper at a preselected angle to said bottom to facilitate nesting of the pan into a subjacent pan of the same construction, and means for preventing jamming of said pan when nested with another pan comprising spaced-apart corner portions of the perimetric wall means defining upper sections extending downwardly from the top flange which are drawn in the pan-forming process to diverge from the uniform taper and extend generally at right angles to the top flange to define at each of their lower ands a curved outwardly-protruding ridge which taken together provide a perimetric dimension greater than that defined by the portions of the top flange which are joined to said spaced-apart sections of the perimetric wall means because of the thickness of the metal of the perimetric wall means, said corner portions further defining lower sections extending downwardly at substantially said preselected angle whereby the pan may nest with a subjacent pan with the ridges resting on the top flange of the subjacent pan to avoid the pans jamming together while effectively maximizing the volume within said perimetric wall means.

2. A pan is defined in claim 1 wherein said metal pan is made of stainless steel.

3. A pan as defined in claim 1 wherein said nontapered upper sections of the side wall curved corners are formed in a draw step which at the same time is producing a taper in the remainder of the curved corners and the side walls.

4. A metal transport pan as defined in claim 1 wherein the perimetric wall means comprises front, rear and end side walls joined at curved corners and said spaced-apart sections are formed at the curved corners.

5. A metal transport pan as defined in claim 1 wherein said corner portions, the top flange, and said ridge comprise concurrently draw formed portions of the pan.

6. A generally rectangular metal transport pan comprising front rear and end side walls joined together at curved corners, a bottom integral with said side walls and curvingly joined to the side walls and to said curved corners at a knuckle radius, a top flange integral with the upper ends of said side walls and extending outwardly therefrom, said side walls and a lower part of the connecting curved corners having substantially the same downward and inward taper to facilitate nesting of the pan into a subjacent pan of the same dimensions, said taper being minimal to maximize the capacity of the pan and which resultingly increases the tendency of nested pans to jam together, the upper ends of said side walls being connected by said curved corners which lie within the intersecting planes of adjacent side wall upper ends, and means for preventing jamming of said pan when nested in said subjacent pan comprising an upper section of the side wall curved corners offset outwardly from said downward and inward taper to extend downwardly from the top flange at right angles thereto to define an outwardly offset arcuate ridge at the lower end of each upper section, said arcuate ridges at the four corners of the pan being sized to provide a perimetric dimension greater than the open top of the pan due to the thickness of the side walls whereby the pan may partially nest within said subjacent pan with the arcuate ridges engaging the top of the side walls of the subjacent pan.

* * * * *